US009271586B2

(12) United States Patent
Ryan

(10) Patent No.: US 9,271,586 B2
(45) Date of Patent: Mar. 1, 2016

(54) MAGNETIC FRAME ASSEMBLY AND MAGNETIC FRAME

(71) Applicant: Collette Ryan, Longmeadow, MA (US)

(72) Inventor: Collette Ryan, Longmeadow, MA (US)

( * ) Notice: Subject to any disclaimer, the term of this patent is extended or adjusted under 35 U.S.C. 154(b) by 0 days.

(21) Appl. No.: 14/516,723

(22) Filed: Oct. 17, 2014

(65) Prior Publication Data

US 2015/0107141 A1 Apr. 23, 2015

Related U.S. Application Data

(60) Provisional application No. 61/893,186, filed on Oct. 19, 2013.

(51) Int. Cl.
*A47G 1/06* (2006.01)
*A47G 1/00* (2006.01)

(52) U.S. Cl.
CPC ..... *A47G 1/06* (2013.01); *A47G 2001/005* (2013.01); *A47G 2001/0672* (2013.01)

(58) Field of Classification Search
CPC ..... A47G 2001/0672; A47G 1/06
See application file for complete search history.

(56) References Cited

U.S. PATENT DOCUMENTS

| | | | | | |
|---|---|---|---|---|---|
| 273,378 | A * | 3/1883 | Miller | 40/781 |
| 1,904,318 | A * | 4/1933 | Lehere | 40/791 |
| 2,401,241 | A * | 5/1946 | Grobholz | 40/749 |
| 2,844,901 | A * | 7/1958 | Eisen | 40/768 |
| 3,579,886 | A * | 5/1971 | Hughes | 40/773 |
| 4,030,220 | A * | 6/1977 | Kotchen | 40/700 |
| 4,305,216 | A * | 12/1981 | Skelton | 40/644 |
| 4,391,054 | A * | 7/1983 | Schovee | 40/700 |
| 4,703,569 | A | 11/1987 | Bowman | |
| 5,125,175 | A * | 6/1992 | Huff, Jr. | 40/718 |
| 5,396,999 | A | 3/1995 | Sandheinrich | |
| 5,787,627 | A * | 8/1998 | Snoke et al. | 40/791 |
| 6,026,606 | A * | 2/2000 | Ross | 40/761 |
| 6,052,933 | A * | 4/2000 | Lytle | 40/711 |
| 6,578,304 | B1 * | 6/2003 | Lytle | 40/711 |
| 6,848,204 | B1 * | 2/2005 | Nowak | 40/209 |
| 8,038,309 | B2 * | 10/2011 | Yang | 362/101 |
| 8,327,659 | B2 | 12/2012 | Winkler et al. | |
| 2003/0217742 | A1 * | 11/2003 | Chien | 125/1 |
| 2006/0052523 | A1 * | 3/2006 | Bushendorf et al. | 524/589 |
| 2006/0185210 | A1 * | 8/2006 | Beigel | 40/711 |
| 2008/0000127 | A1 * | 1/2008 | Shimer | 40/768 |
| 2011/0283574 | A1 * | 11/2011 | Ellman et al. | 40/209 |

OTHER PUBLICATIONS

International Search Report dated Jan. 29, 2015; International Application No. PCT/US2014/061059; International Filing Date Oct. 17, 2014; (9 pages).

Written Opinion dated Jan. 29, 2015; International Application No. PCT/US2014/061059; International Filing Date Oct. 19, 2014; (5 pages).

* cited by examiner

*Primary Examiner* — Gary Hoge
(74) *Attorney, Agent, or Firm* — Cantor Colburn LLP

(57) ABSTRACT

A magnetic frame assembly includes an outer portion including an outer perimeter, an inner perimeter, a front side and a back side; an inner portion configurable with said outer portion, said inner portion including an outer perimeter, a front side and a back side, and a magnetic material disposed on at least one of the back side of the outer portion and the back side of the inner portion. The inner perimeter of the outer portion defines a nesting region configurable with the outer perimeter of the inner portion such that said inner portion is removably insertable into said nesting region.

9 Claims, 6 Drawing Sheets

MAGNETIC FRAME ASSEMBLY AND MAGNETIC FRAME

CROSS REFERENCE TO RELATED APPLICATION

This application claims priority to U.S. Provisional Application No. 61/893,186, filed Oct. 19, 2013, and all of the benefits accruing therefrom under 35 U.S.C. §119, the content of which is herein incorporated by reference in its entirety.

BACKGROUND

The display of various types of materials (e.g. artwork, photographs, schedules, calendars, etc.) on metallic surfaces may be used to decorate what might otherwise be a relatively unattractive surface, or to provide easy access to important information. Some display materials are designed to include magnetic substances as components in their design in order to facilitate adherence of the display material to the metallic surface. Other display materials which do not include magnetic substances and which are non-magnetic by nature, for example, photographs or pieces of artwork, require the use of a separate magnet to anchor the display material to the metallic surface.

Magnetic frames having an improved configuration which may be used to attractively frame and hold frameable materials on metallic surfaces would be desirable.

SUMMARY

Disclosed herein is a magnetic frame assembly including an outer portion having an outer perimeter, an inner perimeter, a front side and a back side; an inner portion configurable with said outer portion, said inner portion including an outer perimeter, a front side and a back side, and a magnetic material disposed on at least one of the back side of the outer portion and the back side of the inner portion; wherein the inner perimeter of the outer portion defines a nesting region configurable with the outer perimeter of the inner portion such that said inner portion is removably insertable into said nesting region.

Also disclosed herein is a magnetic frame including an outer portion including an outer perimeter, an inner perimeter, a front side and a back side, wherein the inner perimeter of the outer portion includes at least one protrusion having a convex shape, a removable inner portion having an outer perimeter, a front side and a back side, wherein the outer perimeter of the inner portion includes at least one cutout having a concave shape, and a magnetic material disposed on at least one of the back side of the outer portion and the back side of the inner portion, wherein the outer portion is in contact with the inner portion along an entire length of the inner perimeter of the outer portion and wherein the outer portion and the inner portion are held together by friction.

The above described and other features are exemplified by the following Figures and detailed description.

BRIEF DESCRIPTION OF THE DRAWINGS

Referring now to the Figures ("FIGs"), which are exemplary embodiments, and wherein the like elements are numbered alike.

DETAILED DESCRIPTION

Figure 1:
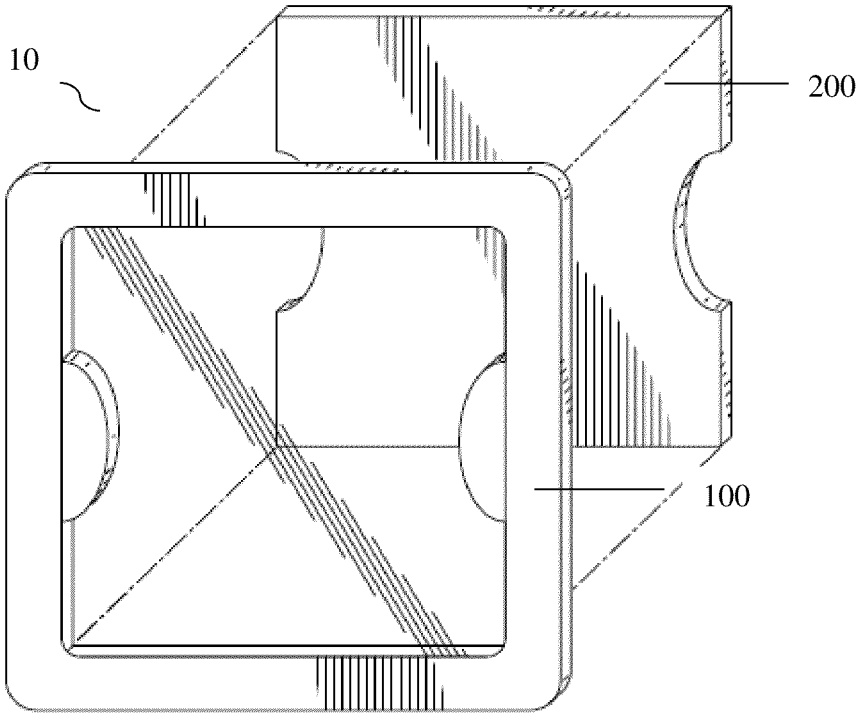
FIG. 1 is a front side perspective view of the separated but configurable outer portion and inner portion of a magnetic frame assembly.

Disclosed herein is a magnetic frame assembly which is mountable to an object. The magnetic frame assembly may be used to frame any type of material capable of being framed such as, for example, a photograph, a piece of artwork, or other content (e.g. calendar, schedule, etc.). A material capable of being framed is referred to herein as a "frameable material." Also disclosed is a magnetic frame formed from the magnetic frame assembly.

A more complete understanding of the components and structures disclosed herein may be obtained with reference to the accompanying drawings, in which various embodiments are shown. This disclosure may however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The magnetic frame assembly and magnetic frame are described herein with reference to FIGS. 1-10.

Figure 2:
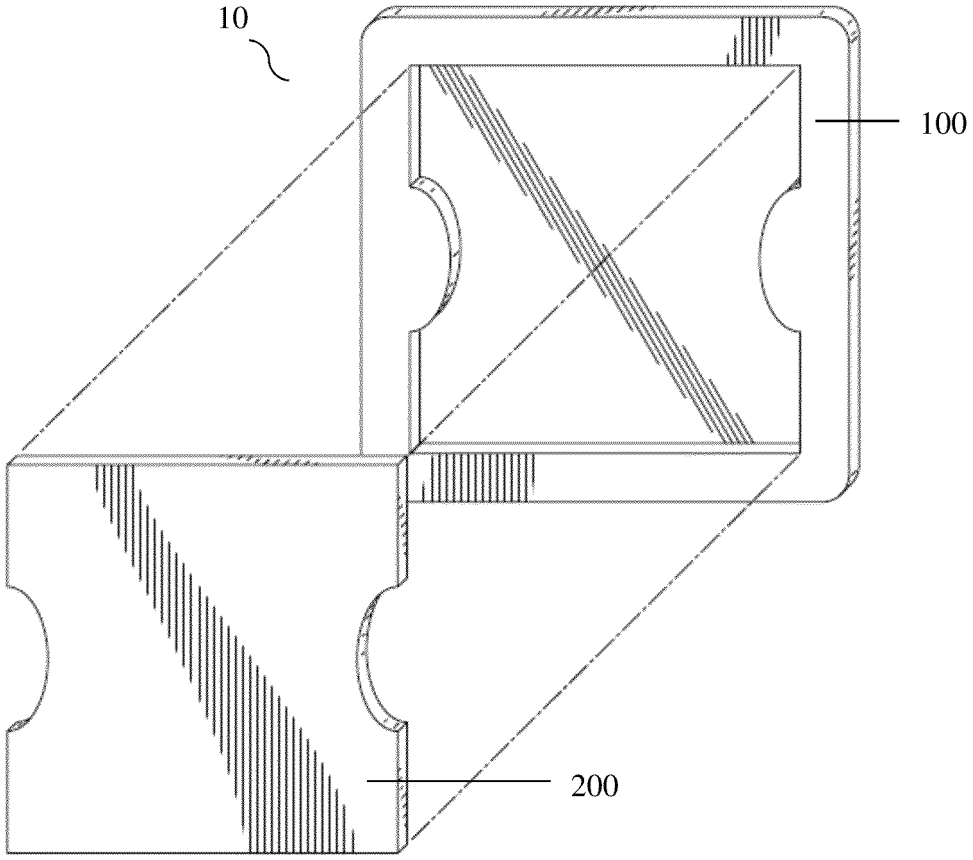
FIG. 2 is a back side perspective view of the separated but configurable outer portion and inner portion of a magnetic frame assembly.
Figure 3:
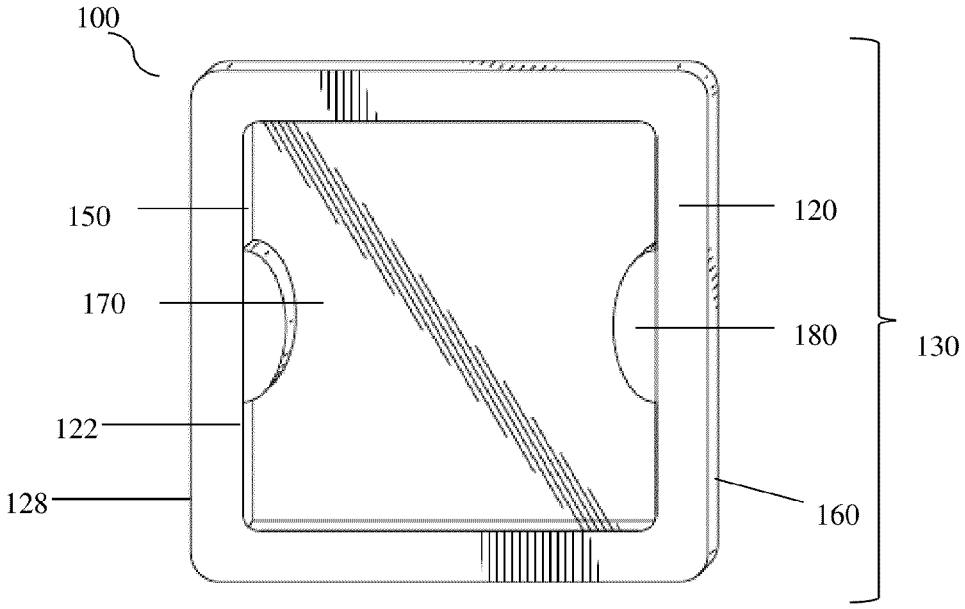
FIG. 3 is a front side perspective view of the outer portion of the magnetic frame assembly of FIG. 1.
Figure 4:
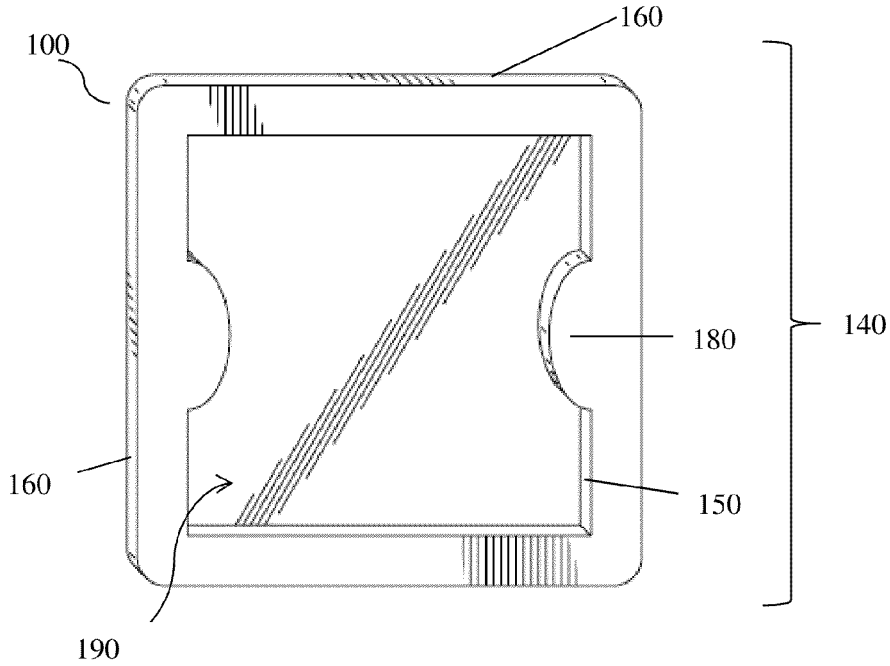
FIG. 4 is a back side perspective view of the outer portion of the magnetic frame assembly of FIG. 2.

FIGS. 1-4 illustrate front and rear view perspectives of an exemplary embodiment of a magnetic frame assembly 10. In particular, FIGS. 1 and 2 are front side and rear side perspective views of the separated but configurable outer portion and inner portion of the magnetic frame assembly. FIG. 3 is a front side perspective view of the outer portion of the magnetic frame assembly, and FIG. 4 is a back side perspective view of the outer portion of the magnetic frame assembly.

The magnetic frame assembly 10 includes an outer portion 100 and an inner portion 200 configurable with the outer portion 100. The outer portion 100 of the magnetic frame assembly 10 includes a front side 130, a back side 140, an inner perimeter 150, and an outer perimeter 160. In exemplary embodiments, the inner perimeter 150 of the outer portion 100 defines a nesting region 190 within the outer portion 100. The nesting region 190 is configurable with the outer perimeter 240 of the inner portion such that said inner portion 200 is removably insertable into the nesting region 190.

The inner perimeter 150 of the outer portion 100 includes at least one protrusion 180 which projects into the nesting region 190. The one or more protrusions may be any shape, such as, for example, convex, triangular, rectangular, polygonal or a combination thereof. In an exemplary embodiment, the one or more protrusions have a convex shape.

The number of protrusions is limited only by the size and shape of the protrusion and the length of the inner perimeter 150. In some embodiments, the inner perimeter 150 includes a single protrusion 180. In other embodiments, the inner perimeter 150 of the outer portion 100 includes two protrusions 180. In an exemplary embodiment, the inner perimeter 150 of the outer portion 100 includes two protrusions 180 positioned on opposite sides of the inner perimeter such that the inner perimeter includes a first protrusion on a first side and a second protrusion on a second opposing side. An exemplary embodiment of an outer portion having two opposing, convex protrusions is illustrated in FIG. 3.

The outer portion 100 may include a transparent protective layer 170 disposed on the surface of the front side 130 of the outer portion. The edges of the transparent protective layer 170 are attached to the surface of the front portion of the outer layer while the unattached portions of the transparent protective layer 170 provide a window through which the frameable material is displayed. The transparent protective layer 170 thus protects the surface of the frameable material which is visible from the front side of the assembled magnetic frame.

In exemplary embodiments, the transparent protective layer 170 is attached to the front side of the outer portion in those areas which do not include the protrusions. Specifically, the transparent protective material is not attached to the protrusions.

The transparent protective layer may be any material which is transparent and which does not significantly increase the total weight of the magnetic frame. According to exemplary embodiments, the transparent protective layer may be formed of a transparent plastic material. Examples of the transparent protective material include at least one of poly(methyl methacrylate) ("PMMA"), polystyrene, polycarbonate, acrylonitrile butadiene styrene ("PETG"), polyethylene terephthalate ("PET") and a combination thereof, but is not limited thereto.

In exemplary embodiments, the front side 130 of the outer portion 100 also includes a border region 120 including an inner perimeter 122 and an outer perimeter 128. The border region 120 may be continuous as shown in FIG. 3. The border region may also be discontinuous.

In embodiments where the magnetic frame assembly includes the transparent protective layer 170, the border region 120 is disposed on, and attached to, the transparent protective layer 170 in those regions of the transparent protective layer which are attached to the front surface of the outer portion. The transparent protective layer 170 is therefore an intervening layer disposed between the border region and the surface of the front side of the outer portion. In optional embodiments, where the magnetic frame assembly does not include a transparent protective layer, the border region is may be disposed directly on the front side of the outer portion in those areas of the outer portion which do not include the protrusions.

Figure 8:
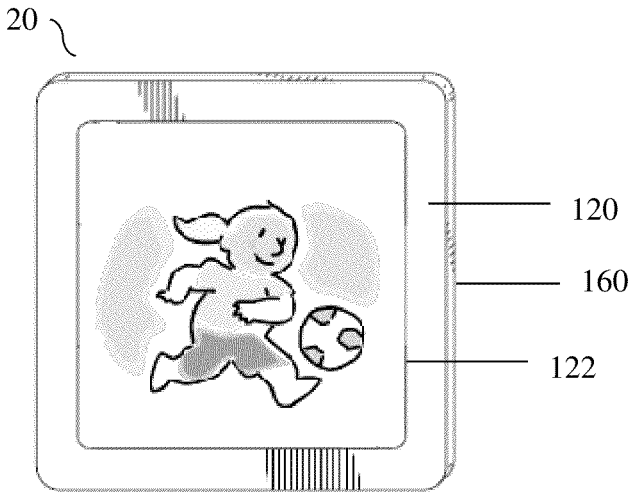
FIG. 8 is a front side perspective view of an assembled magnetic frame in which a frameable material is present within the frame.
Figure 9:
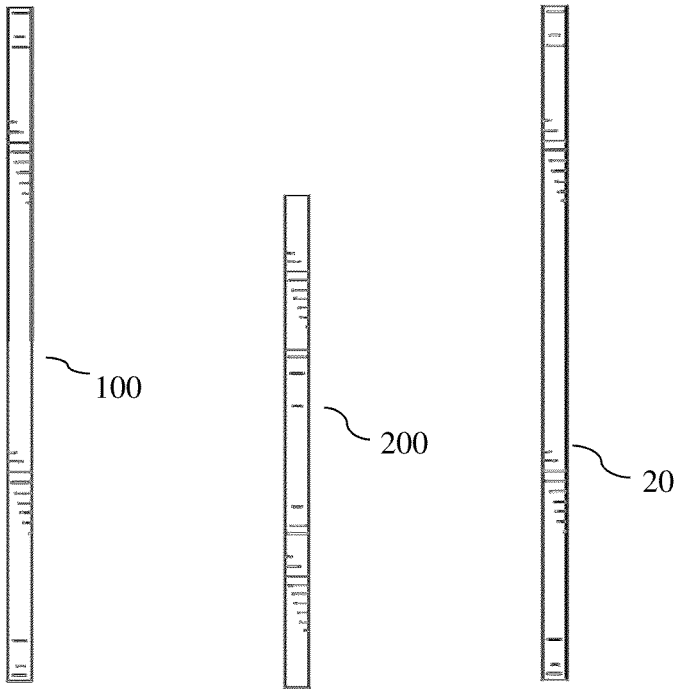
FIG. 9 is a side elevation view of the outer portion (100), the inner portion (200) and the assembled magnetic frame (20)
Figure 10:
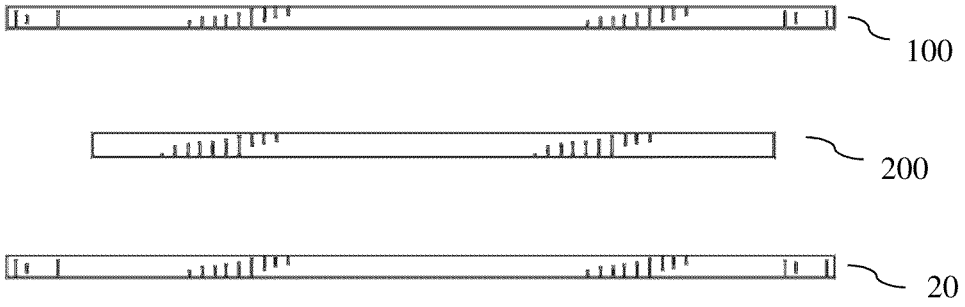
FIG. 10 is a top elevation view of the outer portion (100), the inner portion (200) and the assembled magnetic frame (20).

With reference to the embodiments illustrated in FIGS. 3 and 8, the inner perimeter 122 of the border region 120 defines the perimeter of the window through which the frameable material is visible when inserted in the magnetic frame 20.

The border region 120 may also enhance the strength, durability and aesthetic qualities of the outer portion 100. In some embodiments, the border region 120 is a decorative border region which provides a decorative embellishment to the front side 130 of the outer portion 100 thereby enhancing the overall aesthetic qualities of the magnetic frame. For example, the border region 120 may be formed from a thin layer of material which includes decorative embellishments. The decorative embellishments may include at least one of colors, textures, shapes, painting, embossing, polished surface, burnished surface, and combinations thereof. The decorative embellishments may be an integral component of the border region material or may be a separate component which is adhered to the surface of the outer region.

Figure 5:
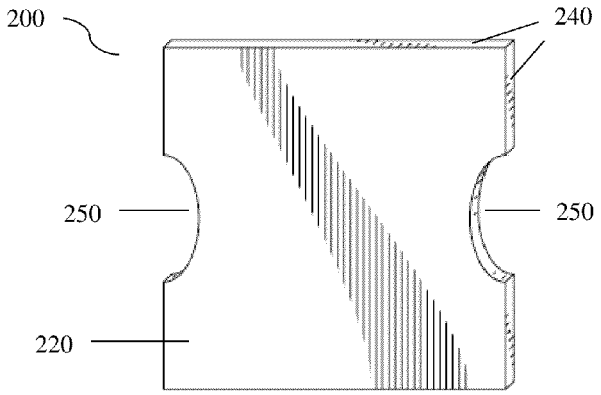
FIG. 5 is a front side perspective view of the inner portion of the magnetic frame assembly of FIG. 1 and FIG. 2.

FIG. 5 is a perspective view of the inner portion of the magnetic frame assembly. The inner portion includes a front side 220, a back side 230 and an outer perimeter 240. In various embodiments, the inner portion 200 is removably insertable into the outer portion 100 by sliding the inner portion 200 into and out of the nesting region 190. Specifically, the inner portion 200 may be inserted into the nesting region 190 by sliding the inner portion 200 into the nesting region 190 along a horizontal axis. Similarly, the inner portion 200 may be removed from the nesting region 190 by sliding the inner portion out of the nesting region. The insertion or removal of the inner portion 200 may be further accompanied by gentle pushing or pulling of the inner portion or the outer portion to ensure that the inner portion is fully inserted into the nesting region, or alternatively, to ensure that the inner portion is fully removed from the nesting region.

In exemplary embodiments, the outer portion 100 and the inner portion 200 are configured so that when the inner portion 200 is inserted in the nesting region 190 the outer portion 100 is in contact with the inner portion 200 along the entire length of the inner perimeter 150 of the outer portion. (See FIG. 7) The outer portion and the inner portion are thus configured so that when the outer portion and the inner portion are conjoined (e.g. assembled), the inner portion fits snug within the outer portion. Due to this snug fit, the outer portion and the inner portion are held together by friction.

The outer perimeter 240 of the inner portion 200 includes at least one cutout 250. The cutout 250 is designed to accommodate the protrusion 180 when the inner portion 200 and the outer portion 100 are conjoined to form the magnetic frame 20. In exemplary embodiments, the position of the protrusion 180 along the inner perimeter of the outer portion and a position of the cutout along the outer perimeter of the inner portion are configured so that when the outer portion and the inner portion are conjoined, the protrusion fits snug within the cutout. The shape of the cutout is thus determined by the shape of the protrusion. Similarly, the number of cutouts is also determined by the number of protrusions. In some embodiments, the outer perimeter 240 of the inner component includes a single cutout 250, while in other embodiments, the outer perimeter 240 of the inner portion 100 includes two cutouts 250.

In an exemplary embodiment, the inner perimeter 150 of the outer portion 100 includes a first protrusion on a first side and a second protrusion on a second opposing side, and the outer perimeter 240 of the inner portion 200 includes a first cutout on a first side and a second cutout on a second opposing side.

The outer portion 100 and the inner portion 200 include a flexible material. The flexible material may be an open-cell foam or a closed-cell foam. The closed-cell foam may be any desirable material, such as but not limited to, at least one of polyethylene, expanded polyethylene, extruded polyethylene, expanded polystyrene, extruded polystyrene foam ("XPS"), nitrile rubber, polyisocyanurate, expanded polypropylene and expanded polyurethane. The open-cell foam may be any desirable material, such as but not limited to, at least one of a polyurethane foam and a visco-elastic polyurethane foam.

The magnetic frame assembly further includes a magnetic material so that the assembled picture frame may be removably attached to a metal surface. In some embodiments, the magnetic material is disposed on the back side of the outer portion and the back side of the inner portion.

The magnetic material may be a layer formed of a flexible sheet of magnetic material (i.e. a magnetic material layer). The flexible sheet of magnetic material may be a thin, light weight material, capable of being adhered to the back side surface of the inner and/or outer portions of the magnetic frame assembly.

The magnetic material layer may be a continuous or discontinuous layer disposed on only a portion of the surface of at least one of the back side of the outer portion and the back side of the inner portion. Alternatively, the magnetic material may be a continuous layer disposed across an entire surface of at least one of the back side of the outer portion and the back side of the inner portion. In exemplary embodiments, the magnetic material is a continuous layer disposed on an entire surface of the back side of the outer portion and a continuous layer disposed on an entire surface of the back side of the inner portion.

The thickness of the magnetic material layer may be about 1 millimeter (mm) to about 20 mm, specifically about 2 mm to about 18 mm, and more specifically about 3 mm to about 15 mm.

The magnetic frame, assembled from magnetic frame assembly, is described with reference to FIGS. 6-10.

Figure 6:
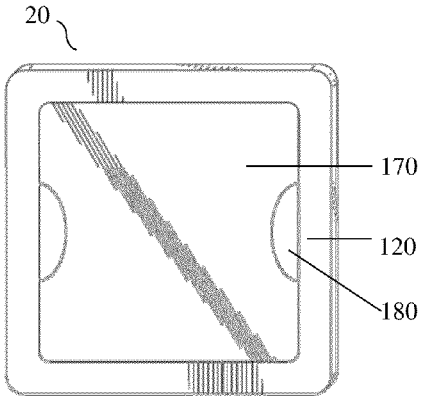
FIG. 6 is a front side perspective view of an assembled magnetic frame in which a frameable material is not present.
Figure 7:
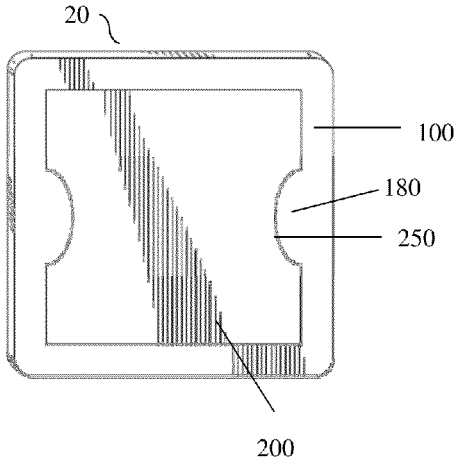
FIG. 7 is a back side perspective view of the assembled magnetic frame of FIG. 6.

FIG. 6 is a front side perspective view of an assembled magnetic frame in which a frameable material is not present. FIG. 8 is a front side perspective view of an assembled magnetic frame in which a frameable material is present within the frame. FIG. 7 is a back side perspective view of the assembled magnetic frame.

FIGS. 9A-9C are side elevation views of the outer portion, the inner portion, and the assembled magnetic frame, respectively. FIGS. 10A-10C are top elevation views of the outer portion, the inner portion, and the assembled magnetic frame respectively.

The magnetic frame 20 is assembled from the magnetic frame assembly 10 (FIGS. 1 and 2). To assemble the magnetic frame, the inner portion 200 is rotated as needed until the cutouts 250 are in alignment with the protrusions 180 in the outer portion. The inner portion 200 is then inserted into the nesting region 190 of the outer portion 100 along a horizontal axis until the back side of the outer portion and the back side of the inner portion are completely aligned along the vertical axis. Thus, when the outer portion and the inner portion are conjoined to form the magnetic frame, the thickness of the assembled magnetic frame is the same as the thickness of the outer portion and/or the inner portion as illustrated in FIGS. 9A-C and FIGS. 10A-C.

The interaction between the outer and inner portions in the assembled magnetic frame is illustrated in FIGS. 6 and 7. In the magnetic frame 20, the outer portion 100 is in direct contact with the inner portion 200 along an entire length of the inner perimeter of the outer portion (FIG. 7). Put another way, the entire length of the outer diameter of the inner portion is in direct contact with the entire length of the inner perimeter of the outer portion. The outer portion and the inner portion are thus configured so that when the outer portion and the inner portion are conjoined, the inner portion fits snug within the outer portion. As a result, the inner portion and the outer portion are held together by friction. The amount of friction between the outer portion and the inner portion is sufficient to prevent easy separation of the inner portion from the outer portion. When the magnetic frame 20 is viewed from the front side of the outer portion in the absence of a frameable material (FIG. 6), it may be possible to view the line demarcating the contact between the one or more protrusions and the one or more cutouts.

The assembled magnetic frame 20 has a variety of potential uses. In some embodiments the magnetic frames may be used to frame any type of material which is capable of being framed such as, for example, a photograph, a piece of artwork, or other content (e.g. calendar, schedule, etc.)

In order to frame a frameable material using the magnetic frame assembly, the outer portion and the inner portion are separated (if already conjoined) and the frameable material is inserted into the nesting region of the outer portion along a horizontal axis. The edge(s) of the frameable material may be inserted between the transparent protective layer and the protrusions in the space defined by the nesting region so as to show the photograph through the transparent protective material when viewed from the front side of the magnetic frame. The portion of the frameable material to be displayed is thus resting against the back of the transparent protective layer, and the frameable material is held in place by the one or more protrusions. Thus in exemplary embodiments, a portion of the photograph is disposed between the protrusion and the transparent protective layer and remaining portions of the photograph are disposed between the transparent protective layer and the inner portion. The transparent protective layer 170 protects the surface of the frameable material that is visible from the front side of the assembled magnetic frame.

Following the insertion of the frameable material, the inner portion may then be rotated as needed to align the cutouts with the protrusions in the outer portion and then inserted into the nesting region of the outer portion along a horizontal axis until the back side of the outer portion and the back side of the inner portion are completely aligned along the vertical axis. As seen in FIG. 8, when the assembled magnetic frame including the frameable material is viewed from the front side of the outer portion through the transparent material, only the frameable material is visible, i.e. the protrusions are not visible. The assembled magnetic frame may then be attached to a metallic surface to display the frameable material.

The outer portion having a magnetic material disposed on the back side may also be used as a magnetic frame without the inner portion. Frameable material may be inserted into the space defined by the nesting region of the outer portion and held in place by the one or more protrusions. The outer portion may then be attached to a metallic surface to display the frameable material.

The shape of the magnetic frame assembly and the magnetic frame formed thereof, are not limited to the shapes illustrated in the present Figures. In exemplary embodiments, the magnetic frame may be any desirable shape, such as but not limited to square, a rectangle, a circle, an oval, a parallelogram, and the like.

The dimensions of the magnetic frame 20 are also not limited, but are designed to appropriately frame the frameable material. Thus the magnetic frame may have a region (window), through which the frameable material is visible which is at least the same size as the material to be framed from edge to edge, so that the frameable material may be readily positioned within the nesting region.

In various embodiments, the dimensions (length and width) of the magnetic frame may be designed to frame materials having standard sizes such as 3×5 inches, 4×6 inches, 8×10 inches, or 14×16 inches. In other embodiments, the dimensions of the magnetic frame may be designed to frame materials which are non-standard in size. The thickness of the magnetic frame is also not limited. In some embodiments, the thickness of the magnetic frame is about 1 mm to about 50 mm, specifically about 2 mm to about 20 mm, and more specifically, about 5 mm to about 15 mm.

In general, the invention may alternately comprise, consist of, or consist essentially of, any appropriate components herein disclosed. The invention may additionally, or alternatively, be formulated so as to be devoid, or substantially free, of any components, materials, ingredients, adjuvants or species used in the prior art compositions or that are otherwise not necessary to the achievement of the function and/or objectives of the present invention.

The terms "a" and "an" and "the" herein do not denote a limitation of quantity, and are to be construed to cover both the singular and the plural, unless otherwise indicated herein or clearly contradicted by context. The terms "comprising," "having," "including," and "containing" are to be construed as open-ended terms (i.e. meaning "including, but not limited to,") unless otherwise noted. Recitation of ranges of values herein are merely intended to serve as shorthand method of referring individually to each separate value falling within the range, unless otherwise indicated herein, and each separate value is incorporated into the specification as if it were individually recited herein. All methods described herein may be performed in any suitable order unless otherwise indicated herein or otherwise clearly contradicted by context. The use of any and all examples, or exemplary language (e.g. "such as") provided herein, is intended merely to better illuminate the invention and does not pose a limitation on the scope of the invention unless otherwise claimed. No language in the specification should be construed as indicating any non-claimed element as essential to the practice of the invention.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value.

The suffix "(s)" as used herein is intended to include both the singular and the plural of the term that it modifies, thereby including one or more of that term (e.g., the film(s) includes one or more films). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

Exemplary embodiments of this invention are described herein, including the best mode known to the inventor for carrying out the invention. Variations of those embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A magnetic frame comprising:

an outer portion having an outer perimeter, an inner perimeter, a front side and a back side, wherein the inner perimeter of the outer portion comprises at least one protrusion, a removable inner portion having an outer perimeter, a front side and a back side, wherein the outer perimeter of the inner portion comprises at least one cutout, and a magnetic material disposed on at least one of the back side of the outer portion and the back side of the inner portion, wherein the outer portion is in contact with the inner portion along an entire length of the inner perimeter of the outer portion and wherein the outer portion and the inner portion are held together by friction, a frameable material disposed between the outer portion and the inner portion, wherein a portion of the frameable material is disposed between the protrusion and a transparent protective layer disposed on the front side of the outer portion and remaining portions of the frameable material are disposed between the transparent protective layer and the inner portion.

2. The magnetic frame of claim 1, wherein a position of the protrusion along the inner perimeter of the outer portion and a position of the cutout along the outer perimeter of the inner portion are configured so that the protrusion is nested within the cutout.

3. The magnetic frame assembly of claim 1, wherein the protrusion has a convex shape and the cutout has a concave shape.

4. The magnetic frame assembly of claim 1, further comprising a border region on the front side of the outer portion.

5. The magnetic frame assembly of claim 1, wherein the outer portion and the inner portion comprise a flexible material.

6. The magnetic frame assembly of claim 1, wherein the flexible material is a closed-cell foam comprising at least one of polyethylene, expanded polyethylene, extruded polyethylene, expanded polystyrene, extruded polystyrene foam (XPS), nitrile rubber, polyisocyanurate, expanded polypropylene and expanded polyurethane.

7. The magnetic frame assembly of claim 1, wherein the flexible material is an open-cell foam comprising at least one of a polyurethane foam and a visco-elastic polyurethane foam.

8. The magnetic frame assembly of claim 1, wherein the magnetic material is disposed on the back side of the outer portion and on the back side of the inner portion.

9. The magnetic frame assembly of claim 1, wherein the magnetic material is a continuous layer disposed on an entire surface of the back side of the outer portion and a continuous layer disposed on an entire surface of the back side of the inner portion.

* * * * *